US011464332B2

(12) United States Patent
Yu et al.

(10) Patent No.: US 11,464,332 B2
(45) Date of Patent: Oct. 11, 2022

(54) REFRIGERATOR

(71) Applicant: LG ELECTRONICS INC., Seoul (KR)

(72) Inventors: Seonil Yu, Seoul (KR); Daesung Lee, Seoul (KR); Hyun Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 173 days.

(21) Appl. No.: 16/704,933

(22) Filed: Dec. 5, 2019

(65) Prior Publication Data

US 2020/0196753 A1 Jun. 25, 2020

(30) Foreign Application Priority Data

Dec. 21, 2018 (KR) ..... 10-2018-0167380

(51) Int. Cl.

| | |
|---|---|
| ***A47B 88/463*** | (2017.01) |
| ***A47B 88/477*** | (2017.01) |
| ***A47B 88/437*** | (2017.01) |
| ***F25D 25/02*** | (2006.01) |

(52) U.S. Cl.

CPC ..... *A47B 88/463* (2017.01); *A47B 88/437* (2017.01); *A47B 88/477* (2017.01); *F25D 25/025* (2013.01); *A47B 2210/0018* (2013.01); *A47B 2210/0037* (2013.01); *F25D 2400/36* (2013.01)

(58) Field of Classification Search

CPC ... A47B 88/463; A47B 88/477; A47B 88/437; A47B 88/457; A47B 2210/0018; A47B 2210/0037; A47B 2210/0175; F25D 25/025; F25D 2400/36

USPC ..... 312/402, 404

See application file for complete search history.

(56) References Cited

U.S. PATENT DOCUMENTS

| | | | | |
|---|---|---|---|---|
| 3,854,785 | A | 12/1974 | Manner et al. | |
| 7,159,957 | B2 * | 1/2007 | Huber | A47B 88/457 312/294 |
| 8,061,790 | B2 * | 11/2011 | Anikhindi | F25D 25/025 312/402 |
| 8,277,004 | B2 * | 10/2012 | Chung | F25D 23/062 312/405 |
| 8,905,501 | B2 * | 12/2014 | Lee | F25D 25/025 312/333 |
| 9,285,155 | B2 * | 3/2016 | Yoo | E05D 15/04 |

(Continued)

FOREIGN PATENT DOCUMENTS

| | | |
|---|---|---|
| CN | 1525125 A | 9/2004 |
| CN | 201334150 Y | 10/2009 |

(Continued)

*Primary Examiner* — Daniel J Troy
*Assistant Examiner* — Timothy M Ayres
(74) *Attorney, Agent, or Firm* — Dentons US LLP

(57) ABSTRACT

A refrigerator having a first storage compartment having a first storage space defined therein, a door disposed on the first storage compartment to open and close the first storage space, a drawer-receiving portion defined in the first storage space; a storage drawer configured to be extendable from and retractable into the drawer-receiving portion, and an actuator disposed on a bottom face of the drawer-receiving portion, wherein the actuator is configured to move the storage drawer in an extended direction as the storage drawer is pressed in a retracted direction.

12 Claims, 12 Drawing Sheets

(56) References Cited

U.S. PATENT DOCUMENTS

| | | | | |
|---|---|---|---|---|
| 9,562,596 | B2 * | 2/2017 | Kamada | F16H 35/10 |
| 9,695,624 | B2 * | 7/2017 | Heydel | H02K 7/116 |
| 9,897,371 | B2 * | 2/2018 | Yang | A47B 88/41 |
| 9,924,796 | B2 * | 3/2018 | Chen | A47B 88/49 |
| 10,139,154 | B2 * | 11/2018 | Lee | A47B 88/497 |
| 10,413,064 | B1 * | 9/2019 | Lu | A47B 88/50 |
| 10,520,246 | B2 * | 12/2019 | Choi | F25D 23/02 |
| 10,591,203 | B2 * | 3/2020 | Kang | F25D 11/02 |
| 2003/0122519 | A1 * | 7/2003 | Huber | A47B 88/457 318/646 |
| 2003/0209958 | A1 * | 11/2003 | Hwang | A47B 88/49 312/331 |
| 2007/0170828 | A1 * | 7/2007 | Hoshide | A47B 88/457 312/319.5 |
| 2007/0222346 | A1 * | 9/2007 | Kleinsasser | A47B 88/463 312/205 |
| 2010/0320890 | A1 * | 12/2010 | Jung | F25D 27/00 312/402 |
| 2013/0285528 | A1 * | 10/2013 | Park | F25D 23/028 312/404 |
| 2015/0027247 | A1 * | 1/2015 | Kamada | F25D 25/025 74/30 |
| 2016/0112679 | A1 * | 4/2016 | Lee | G06T 7/38 312/7.2 |
| 2017/0184337 | A1 | 6/2017 | Querfurth et al. | |
| 2017/0292777 | A1 | 10/2017 | Lee | |
| 2018/0132615 | A1 * | 5/2018 | Kim | F16C 29/02 |
| 2019/0242640 | A1 * | 8/2019 | Minoru | A47B 88/453 |
| 2020/0011593 | A1 * | 1/2020 | Ji | F25D 25/025 |
| 2020/0158419 | A1 * | 5/2020 | Eom | F25D 23/028 |
| 2020/0182539 | A1 * | 6/2020 | Hwang | F25D 29/00 |

FOREIGN PATENT DOCUMENTS

| | | | |
|---|---|---|---|
| CN | 101889774 | A | 11/2010 |
| CN | 103069236 | A | 4/2013 |
| CN | 103335482 | A | 10/2013 |
| CN | 204027119 | U | 12/2014 |
| CN | 107144073 | A | 9/2017 |
| CN | 108168199 | A | 6/2018 |
| DE | 102016013077 | A1 | 5/2018 |
| JP | 2000-046465 | A | 2/2000 |
| JP | 2007-147254 | A | 6/2007 |
| JP | 2009-228911 | * | 10/2009 |
| JP | 2015-210058 | A | 11/2015 |

* cited by examiner

A - A'

B - B'

C-C'

D - D'

E-E'

REFRIGERATOR

CROSS-REFERENCE TO RELATED APPLICATION

This application claims the benefit of Korean Patent Application No. 10-2018-0167380, filed on Dec. 21, 2018, with the Korean Intellectual Property Office, the entire content of which is incorporated herein by reference.

BACKGROUND

1. Field

The present disclosure relates to a refrigerator, and more particularly to, a storage drawer provided in the refrigerator.

2. Description of Related Art

A refrigerator is an apparatus for freezing or refrigerating and storing food and the like by maintaining a temperature of a storage compartment disposed in the refrigerator at a predetermined temperature using a freezing cycle composed of a compressor, a condenser, an expansion valve, and an evaporator. In general, the refrigerator includes a freezing compartment for freezing and storing food or beverages and a refrigerating compartment for storing the food or beverages at low temperatures.

Refrigerators are distinguished based on locations of the freezing compartment and the refrigerating compartment. For example, the refrigerators may be divided into a top mount type with the freezing compartment located above the refrigerating compartment, a bottom freezer type with the freezing compartment located below the refrigerating compartment, and a side by side type with the freezing compartment and refrigerating compartment divided left and right by a partition.

Recently, to meet consumer demand, temperatures of the refrigerating compartment and the freezing compartment are able to be freely adjusted based on the food stored in the refrigerator. Refrigerators that allows uses of a larger refrigerating compartment by allowing the freezing compartment to have the same temperature as the refrigerating compartment have been proposed and used.

In one example, a food storage location may vary depending on a type, processing and packaging conditions of the food. The refrigerating compartment and the freezing compartment may have separate shelves, drawers, baskets, and the like arranged therein for storing food.

A variety of food for refrigeration or freezing storage may be properly stored in the shelves, drawers, baskets, and the like arranged in the refrigerating compartment and freezing compartment of the refrigerator. The drawers, shelves, baskets, and the like may be arranged in various ways in the refrigerating and freezing compartments to store the variety of food of various sizes and storage conditions.

In one example, in a case of a drawer of a refrigerator according to prior art configurations, in order to store food, a user must repeatedly perform an operation of extending and opening the drawer and an operation of retracting and closing the drawer.

Therefore, it is inconvenient to carry out an operation relatively frequently or to store the food in a state in which both hands or one hand are in use.

Further, in the case of the refrigerator drawer according to prior art configurations, the drawer must be extended in order to store food therein, and a handle for extending the drawer is necessary. The handle of the drawer inevitably limits designs of the refrigerator and storage space.

SUMMARY

The present disclosure solves at least the above problems.

One purpose of the present disclosure is to provide a refrigerator in which a structure of a storage drawer of the refrigerator is improved, thereby improving user convenience.

Another purpose of the present disclosure is to provide a refrigerator in which a structure of a storage drawer of the refrigerator is improved, so that the storage drawer may be opened by a simple operation.

Another purpose of the present disclosure is to provide a refrigerator in which a structure of a front face of a drawer is improved and at the same time the drawer is able to extend automatically.

It is understood that purposes of the present disclosure are not limited to the above-mentioned purpose. Other purposes and advantages of the present disclosure as not mentioned above may be understood from following descriptions and more clearly understood from embodiments of the present disclosure. Further, it will be readily appreciated that the purposes and advantages of the present disclosure may be realized by features and combinations thereof as disclosed in the claims.

One object of the present disclosure provides a refrigerator comprising: a first storage compartment having a first storage space defined therein; a door disposed on the first storage compartment to open and close the first storage space; a drawer-receiving portion defined in the first storage space; a storage drawer configured to be extendable from and retractable into the drawer-receiving portion; and an actuator disposed on a bottom face of the drawer-receiving portion, wherein the actuator is configured to move the storage drawer in an extended direction as the storage drawer is pressed in a retracted direction.

In one embodiment, the actuator includes: a bracket placed on a bottom face of the storage drawer; and a push-opening damper placed on a bottom face of the drawer-receiving portion, wherein while the storage drawer is in a retracted state, the push-opening damper is configured to be maintained to be in contact with the bracket, wherein as the storage drawer is pressed in a retracted direction, the push-opening damper is configured to be pressed by the bracket to disactivate a locked state thereof and then to press the bracket such that the storage drawer moves in an extended direction.

In one embodiment, as the storage drawer moves in an extended direction, the bracket presses the push-opening damper such that the push-opening damper is brought back into a locked state.

In one embodiment, the push-opening damper includes: an actuating protrusion configured: to be kept in contact with the bracket in a retracted state of the storage drawer; to press the bracket in an extended direction as the storage drawer is pressed in a retracted direction; and to be in contact with the bracket as the storage drawer moves from an extended state in a retracted direction and then to be moved in a retracted direction of the drawer and locked; and a protrusion receiving groove receiving therein the actuating protrusion to limit a movement distance of the actuating protrusion.

In one embodiment, the actuator includes: a guide rail disposed on a bottom face of the drawer-receiving portion, and extending in the extended and retracted directions of the storage drawer; and a movable portion disposed on a bottom face of the storage drawer, and configured to move along the guide rail in a contact manner therewith.

In one embodiment, the refrigerator further includes a roller assembly positioned on a front position of a bottom face of the storage drawer and supporting the bottom face of the storage drawer to guide movement of the storage drawer.

In one embodiment, the actuator includes: an elongate mounted groove extending in a parallel manner with the extended and retracted directions of the storage drawer; a frictional bracket disposed on a bottom face of the storage drawer and disposed to be movable inside the mounted groove based on extension and retraction of the storage drawer; and a frictional member disposed in the mounted groove to limit a speed of movement of the storage drawer by frictional resistance with the frictional bracket.

In one embodiment, the frictional member has a length equal to or less than half a total length of the mounted groove.

In one embodiment, a front stopping protrusion is formed on a front portion of the bottom face of the drawer-receiving portion, and wherein a rear stopping protrusion is formed on a rear portion of the bottom face of the storage drawer to be mounted on the front stopping protrusion as the storage drawer extends.

In one embodiment, the refrigerator further includes a second storage compartment having a second storage space defined therein, below the first storage compartment, wherein the second storage compartment operates independently of the first storage compartment.

In one embodiment, the second storage compartment includes at least one drawer that extends from the second storage space to open the second storage space.

In one embodiment, the door further includes: a manipulator configured to control the first storage compartment and the second storage compartment; and a display configured to display operation states of the first storage compartment and the second storage compartment.

Effects of the present disclosure are as follows but are not limited thereto.

According to the refrigerator of the present disclosure, the structure of the storage drawer of the refrigerator may be improved to give the user the convenience.

Further, according to the refrigerator of the present disclosure, the structure of the storage drawer of the refrigerator may be improved to open the storage drawer with the simple operation.

Furthermore, according to the refrigerator of the present disclosure, the structure of the front face of the drawer may be improved and at the same time the drawer may be able to extend automatically.

BRIEF DESCRIPTION OF THE DRAWINGS

The accompanying drawings constitute a part of this specification and illustrate an embodiment of the present disclosure and together with the specification, explain the present disclosure.

DETAILED DESCRIPTIONS

Figure 1:
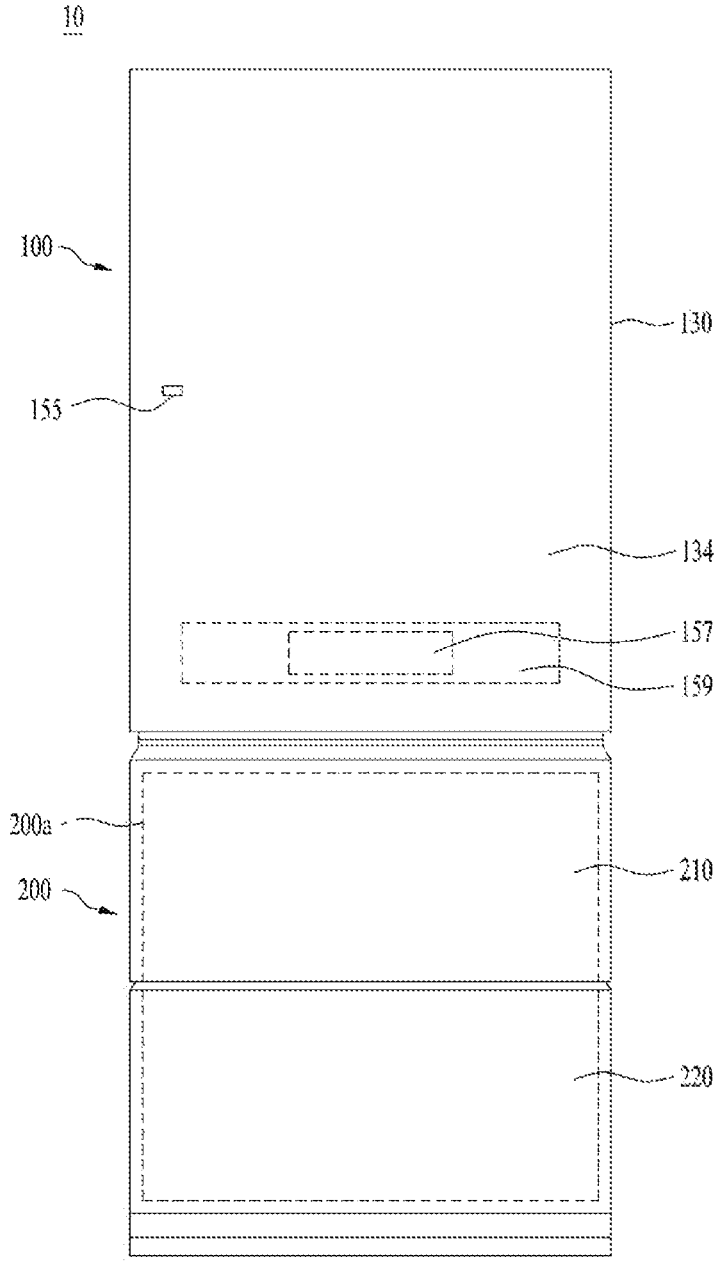
FIG. 1 is a front view of a refrigerator according to an embodiment of the present disclosure.

For simplicity and clarity of illustration, elements in the figures are not necessarily drawn to scale. The same reference numbers in different figures denote the same or similar elements, and as such perform similar functionality. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

In describing the components of the embodiment(s) of the present disclosure, terms such as first, second, A, B, (a), and (b) may be used. These terms are only for distinguishing the components from other components, and the nature, order or order of the components are not limited by the terms. If a component is described as being "connected", "coupled" or "connected" to another component, it should be understood that the component may be directly connected or connected to that other component, but having other components there between.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

First, the refrigerator according to one embodiment of the present disclosure will be described in detail with reference to the accompanying drawings.

Figure 2:
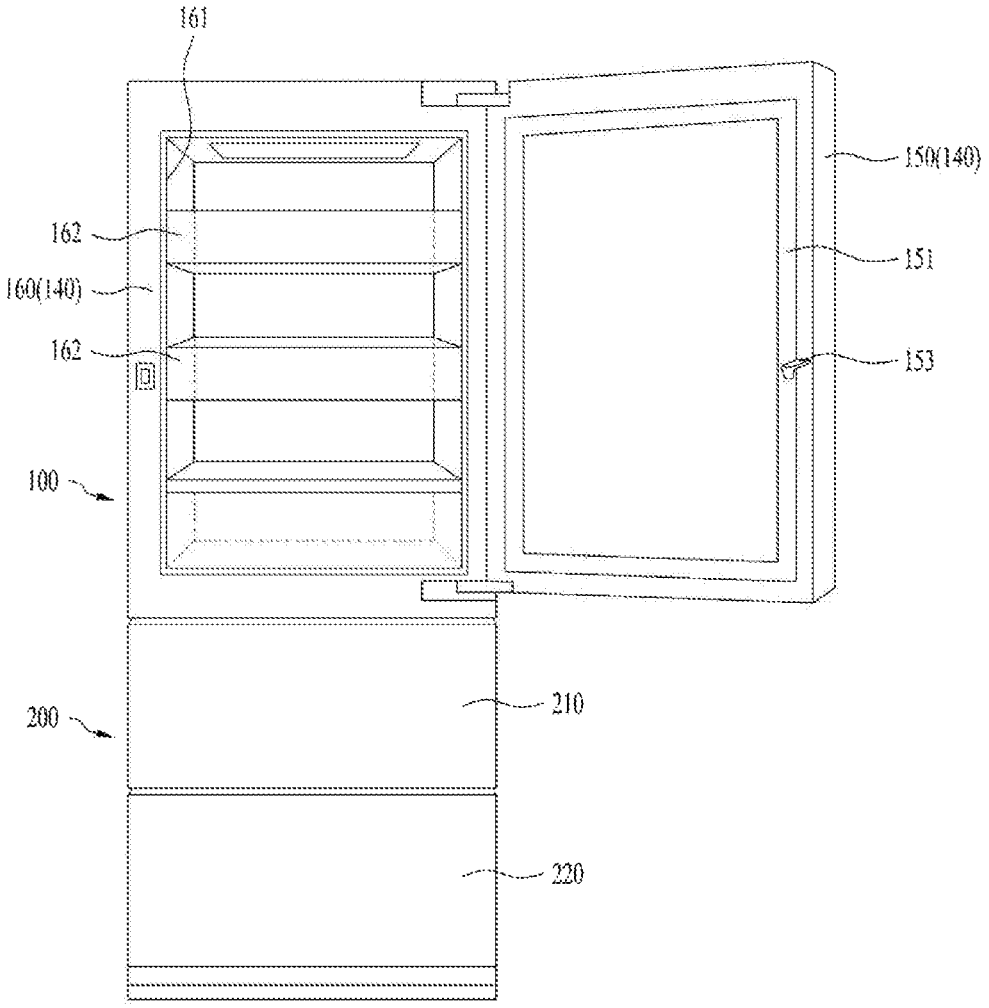
FIG. 2 is a front view illustrating a state in which an outer door of a refrigerator is open according to an embodiment of the present disclosure.

FIG. 1 is a front view of a refrigerator according to an embodiment of the present disclosure. Further, FIG. 2 is a front view illustrating a state in which an outer door of a refrigerator is open according to an embodiment of the present disclosure. Further, FIG. 3 shows a front view illustrating a state in which an inner door of a refrigerator is open according to an embodiment of the present disclosure.

Figure 3:
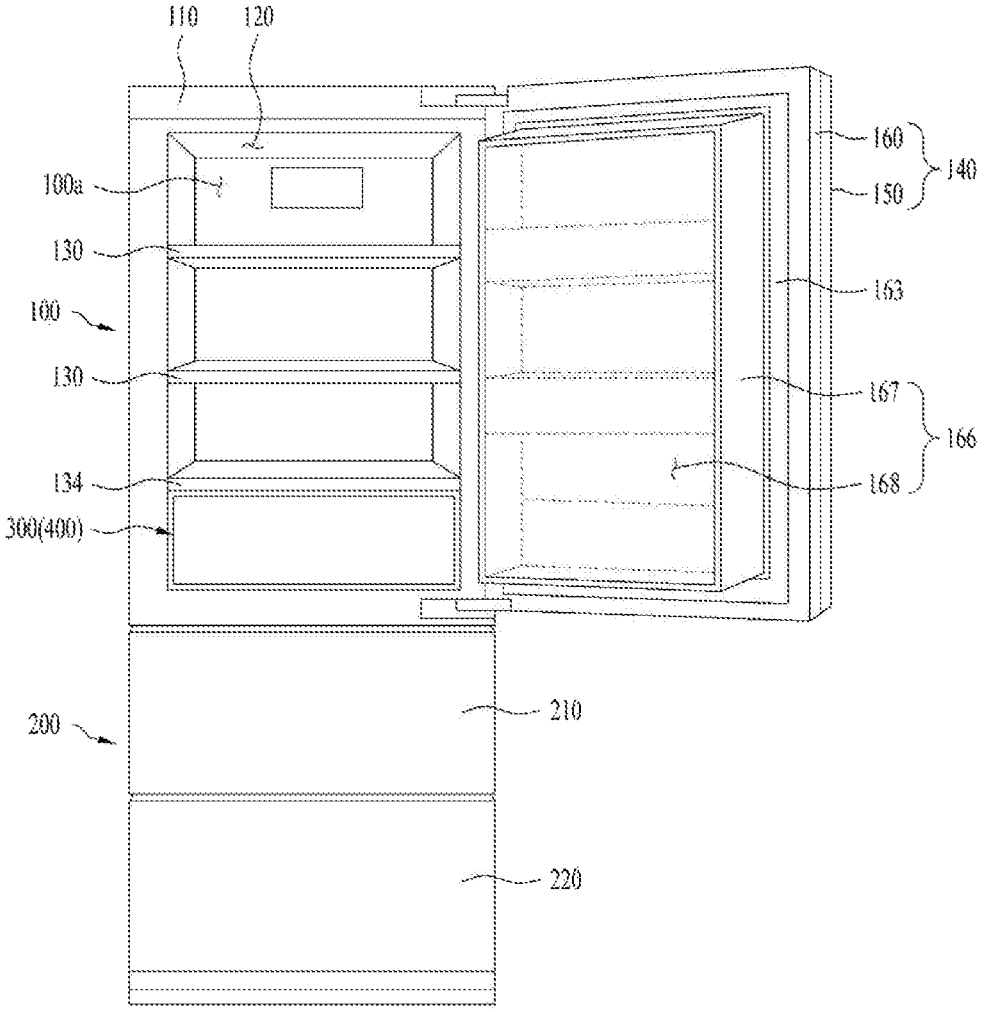
FIG. 3 shows a front view illustrating a state in which an inner door of a refrigerator is open according to an embodiment of the present disclosure.

As shown in FIGS. 1 to 3, a refrigerator 10 may be formed having a substantially rectangular parallelepiped shape with an open front face. The shape is not limited thereto. The refrigerator 10 may include a first storage compartment 100 disposed at an upper portion of the refrigerator 10 to define a first storage space 100*a* therein and a second storage compartment 200 disposed below the first storage compartment 100 to define therein a second storage space 200*a*, which is opened and closed in a form of a drawer. The upper portion of the refrigerator 10 is relative to the ground and above a lower portion of the refrigerator 10.

In this embodiment, the first storage space 100*a* or the second storage space 200*a*, which is a storage space for storing food or other items therein, may be selectively disposed as a refrigerating compartment or a freezing compartment. In the present embodiment, for convenience purposes it is described that the first storage space 100*a* and the second storage space 200*a* are used as the refrigerating compartments, but they are not limited to the refrigerating compartments.

Depending on a type or a temperature of food or other items to be stored in the first storage space 100*a* or in the second storage space 200*a*, the first storage space 100*a* and the second storage space 200*a* may be selectively used as the refrigerating compartment/freezing compartment or the freezing compartment/refrigerating compartment, respectively. Alternatively, both the first storage space 100*a* and the second storage space 200*a* may be used as the refrigerating compartments or the freezing compartments.

In one example, the first storage space 100*a* may have a front opening defined therein. The first storage space 100*a* may include a plurality of shelves 130 for loading foods to be stored in the first storage space 100*a* and a storage drawer 300 defining therein a storage space that may be separated from the first storage space 100*a*.

In this embodiment, the plurality of shelves 130 are detachably arranged to variously adjust a space interval therebetween based on a type and a size of the food to be stored in the first storage space 100*a*. The storage drawer 300 is disposed so as to be extendable from a drawer-receiving portion 400 defined by a partitioning plate 134 disposed at a lower portion of the first storage space 100*a*.

In one example, the storage drawer 300 disposed extendable from and retractable into the drawer-receiving portion 400 may be opened and closed by a guide 430, a roller assembly 440, an opening mechanism 450, a locker 460, and a stopper 470 arranged on a bottom face of the drawer-receiving portion 400. Although not limiting, such storage drawer and the guide 430, the roller assembly 440, the opening mechanism 450, the locker 460, and the stopper 470 will be described in detail later with reference to a separate drawing.

Further, a door 140 for opening and closing the first storage space 100*a* and defining therein a separate door storage space separated from the first storage space 100*a* at the same time is disposed at one side of the opening of the first storage space 100*a*. The door 140 is preferably pivotally attached to one side of the opening of the first storage space 100*a*, such as shown in FIGS. 2 and 3.

In this embodiment, the door 140 may include an inner door 160 for opening and closing the first storage space 100*a* and simultaneously including a home bar space defined therein, which is a separate storage space and an outer door 150 disposed to open and close the storage space of the inner door 160.

Widths and lengths of the outer door 150 and the inner door 160 may be the same. Further, a plurality of door baskets or containers (not shown) may be spaced apart from each other in a vertical direction at a rear face of the outer door 150, that is, a face facing the inner door 160.

An outer door gasket 151 may surround edges on the rear face of the outer door 150. A latch 153 may be disposed at the rear face of the outer door 150 on a side edge thereof, which is opposite to a side of the outer door 150 where a pivot axis is formed. The latch 153 may be disposed at an outer side of the outer door gasket 151.

In one example, a manipulator 157 (controller) for controlling operation states of the first storage compartment 100 and the second storage compartment 200 of the refrigerator 10 and a display 159 for indicating the operating states of the first storage compartment 100 and the second storage compartment 200 may be disposed on an outer face of the outer door 150. The manipulator 157 may include a button-type or touch-type input part. The manipulator 157 may be configured with buttons, a dome-shaped switch, a resistive/capacitive touch pad, a dial (jog wheel), jog switch (jog switch), the finger mouse, rotary switch, dial (jog dial), and other means to produce the input data by a specific operation such as pushing, rotating, pressing and contacting the like. The display 159 may be a light emitter (e.g. a light emitting diode (the LED), liquid crystal display (LCD) or organic electroluminescent (EL) display). The display 159 may receive a variety of manipulation signals for operating the refrigerator and displays information on the operation of the refrigerator to an external side.

In one example, an opening 161 with a predetermined size is provided in a center portion of the inner door 160 and a receiving casing 166 is provided on a rear face of the inner door 160. The opening 161 access into the receiving casing 166 in a state in which the inner door 160 is closed and the outer door 150 is opened.

In this embodiment, the outer door gasket 151 surrounded on the rear face of the outer door 150 is in close contact with a front face of the inner door 160 and the opening 161 is enclosed along outer edges of the outer door gasket 151. Therefore, when the outer door 150 is in close contact with the front face of the inner door 160, e.g., when the outer door 150 is closed, a phenomenon in which cold air flows out between the inner door 160 and the outer door 150 is blocked.

In one example, a plurality of door baskets 162 may be mounted or disposed in the opening 161 of the inner door 160. The plurality of door baskets 162 may be spaced apart from each other at predetermined intervals in the vertical direction of the inner door 160.

Further, a door dike 165 may protrude from an edge of the rear face of the inner door 160 and a front end of the receiving casing 166 may be coupled to the door dike 165. An inner door gasket 163 may surround edges on the rear face of the inner door 160, which corresponds to an outer side of the door dike 165.

Therefore, when the inner door 160 is in close contact with a front face of outer casing 110, e.g., when the inner door 160 is closed, the inner door gasket 163 is in close contact with the front face of the outer casing 110 of the first storage compartment 100, so that the cold air inside the first storage space 100*a* is prevented from leaking to the outside.

Further, a lock 164 may be disposed on the front face of the inner door 160, preferably, at a point corresponding to the latch 153 in a state in which the outer door 150 is closed. When the outer door 150 is in close contact with the front face of the inner door 160, the latch 153 is configured to fasten or engage with the lock 164, so that the outer door 150 may be kept closed.

Further, a door switch 155 may be disposed on an upper side (top) or a lower side (bottom) of the front face of the inner door 160. The door switch 155 may be disposed away from the pivot axis of the outer door 150 or may be disposed at a point close to the pivot axis.

The second storage compartment 200 may be located below the first storage compartment 100 and may have one or more drawers 210 and 220 that are configured to extend forward from the refrigerator 10. In a case of the second storage compartment 200, the second storage space 200*a*, where the food is stored therein, may be exposed by the extension of the drawers 210 and 220. Further, the second storage space 200*a* may be divided by the plurality of drawers 210 and 220.

In one example, the second storage compartment 200 may be used as the refrigerating compartment or the freezing compartment independently of the first storage compartment 100. The second storage compartment 200 may have one or more drawers 210 and 220 that open the second storage space 200*a* of the second storage compartment 200 and define spaces for storing the food therein.

In this embodiment, the drawers 210 and 220 may have an upper drawer 210 forming an upper front face of the second storage compartment 200 and a lower drawer 220 forming a lower front face of the second storage compartment 200. The upper and lower front faces of the second storage compartment 200 may form exterior surfaces of the refrigerator visible.

In one example, a refrigerating cycle apparatus (not shown) for adjusting temperatures of the first storage space 100*a* and the second storage space 200*a* may be disposed inside the refrigerator 10, in a separate space separated from the first storage space 100*a* and the second storage space 200*a*.

In this embodiment, the refrigerating cycle apparatus may have a refrigerant cycle composed of a compressor, a condenser, an expander, and an evaporator and a flow path for supplying the cold air into the first storage space 100*a* and the second storage space 200*a*. The position and a configuration of the refrigerating cycle apparatus may vary according to design preference. Thus, a detailed description thereof will be omitted.

Hereinafter, the storage drawer 300 and the drawer-receiving portion 400 for retracting and extending the storage drawer 300 will be described in detail with reference to the accompanying drawings.

First, the storage drawer according to the present disclosure will be described with reference to FIGS. 4 to 6.

Figure 4:
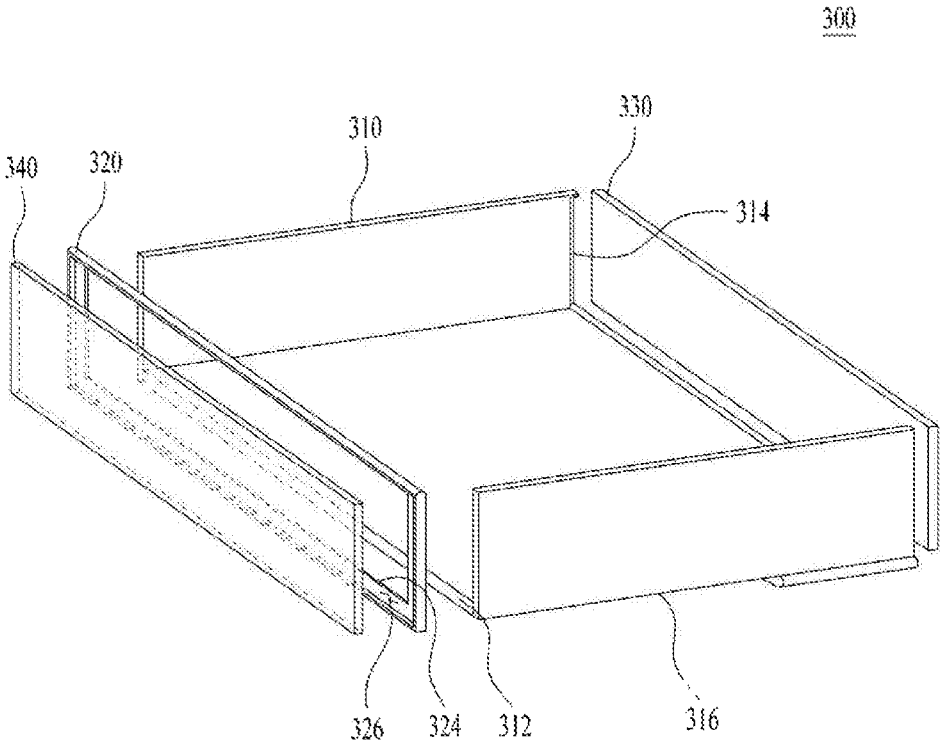
FIG. 4 is an exploded perspective view illustrating a storage drawer of a refrigerator according to an embodiment of the present disclosure.
Figure 5:
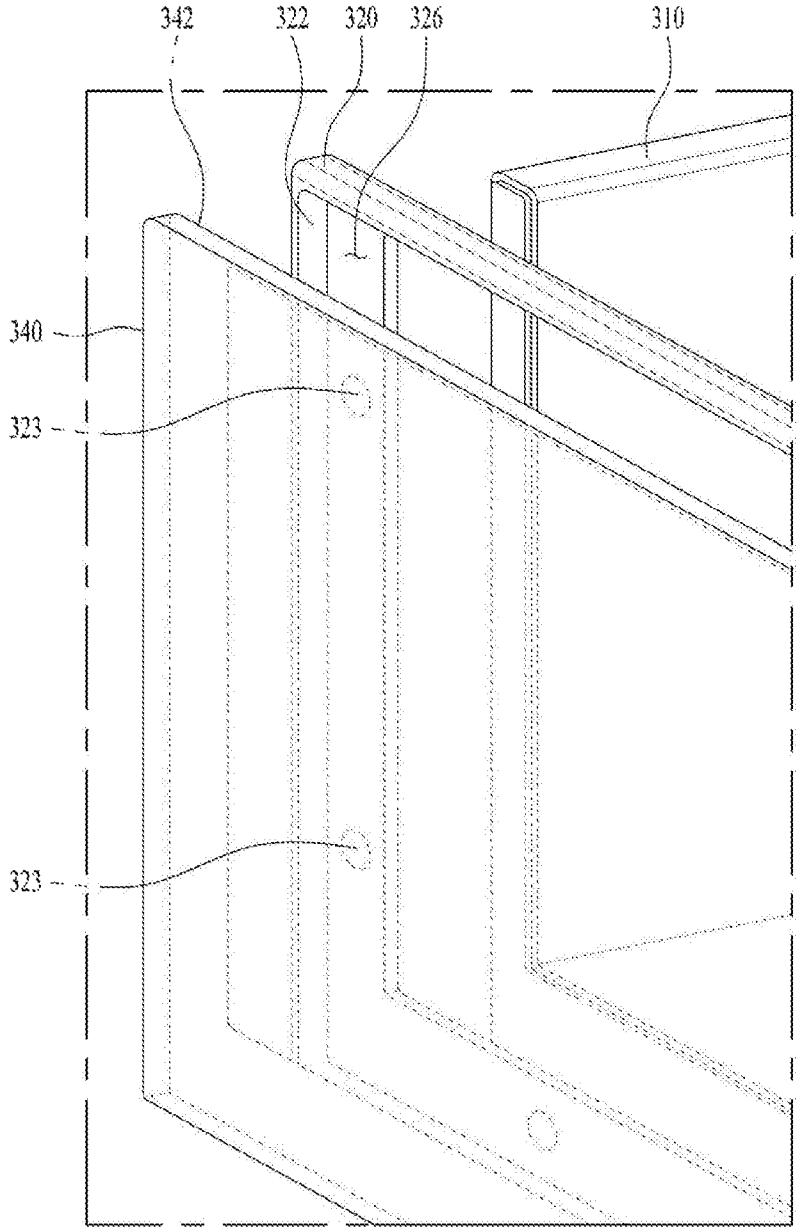
FIG. 5 shows an exploded perspective view of components of a storage drawer according to an embodiment of the present disclosure.

FIG. 4 is an exploded perspective view illustrating a storage drawer of a refrigerator according to an embodiment of the present disclosure. FIG. 5 shows an exploded perspective view of components of a storage drawer according to an embodiment of the present disclosure. FIG. 6 is an exploded perspective view of a storage drawer and an actuator according to an embodiment of the present disclosure.

As shown in FIG. 4, the storage drawer 300 may have a casing shape (not limited thereto) with a top portion open to be inserted into the drawer-receiving portion 400 defined below the first storage space 100*a* of the first storage compartment 100 by the partitioning plate 134.

The storage drawer 300 may include a body 310 having a front face, a rear face, and a top face that are each open, a front frame 320 fastened to the front face of the body 310 to form a front face perimeter of the storage drawer 300, a transparent material portion 340 attached to the front frame 320 to allow food or other items stored in the storage drawer 300 to be visible from the outside, and a rear frame 330 fastened to a rear side of the storage drawer 300 to form a rear face of the storage drawer 300.

In this embodiment, the body 310 may be formed by press-forming a metal plate having a predetermined thickness in a 'U' shape. The body 310 may be formed by bending a front fastened face 312 to be fastened to the front frame 320 by a separate fastening bolt (not shown), on a front side of the body 310. Further, on a rear inner circumferential face of the body 310, a rear fastened face 314 having fastened hole (not shown) to be fastened to the rear frame 330 by a separate fastening bolt (not shown) defined therein is formed.

In one example, the front frame 320, which is fastened to a front face of the body 310 to form the front face of the storage drawer 300 together with the transparent material portion 340, may be formed in a hollow space frame shape that has an opening 324 passing through a center portion of the front frame 320. A step 322, which is recessed by a thickness of the transparent material portion 340, is formed on an inner circumferential face of the front frame 320 such that the transparent material portion 340 is inserted therein and attached thereto.

Further, as an inner circumferential surface of step 322, an adhered face 326, which is fastened to the front fastened face 312 of the body 310, and at the same time, to which the transparent material portion 340 is attached, extends inwardly of the opening 324. In this embodiment, the adhered face 326 may further include a plurality of fastened holes 323 defined therein to be fastened to the front fastened face 312 of the body 310 by the fastening bolts.

In one example, the transparent material portion 340, which may be attached to the adhered face 326 of the front frame 320 by a separate adhesive member, e.g., a double-sided tape, is preferably formed of a transparent plate. Therefore, a user may visually check the food stored in the storage drawer 300 through the transparent portion 340 without having to open the storage drawer 300. Such transparent material portion 340 may be formed of a transparent resin, glass, tempered glass, and the like.

A screening face 342 for preventing the adhesive member (not shown) for attachment to the front frame 320 from being exposed may be applied or coated on edges of a rear face of the transparent material portion 340. That is, in a case of the transparent material portion 340 of the transparent material, the adhesive member for the attachment to the transparent material portion 340 may be seen from the outside. Thus, the screening face 342 for preventing the adhesive member from being exposed may be further formed to have the same area as an area corresponding to an attachment area on the rear face of the transparent material portion 340 of the adhesive member.

In one example, the rear frame 330, which is fastened to a rear side of the body 310 to form a rear face of the storage drawer, is formed of a plate having a predetermined thickness. The rear frame 330 may be inserted into a rear and inner side of the body 310 and fixed to the body 310 by fasteners (not shown) passing through the plurality of fastened holes (not shown) defined in the rear fastened face 314 of the body 310.

In one example, a plurality of components that are linked to a guide 430, a roller assembly 440, an opening mechanism 450, a locker 460, and a stopper 470 installed in the drawer-receiving portion 400 (described in more detail below) may be arranged on the bottom face 316 of the body 310. The respective components arranged on the bottom face 316 of the body 310 will be described in detail in the description of the guide 430, the roller assembly 440, the opening mechanism 450, the locker 460, and the stopper 470.

Hereinafter, the drawer-receiving portion 400 disposed in the first storage space 100*a* will be described in detail with reference to the accompanying drawings.

Figure 6:
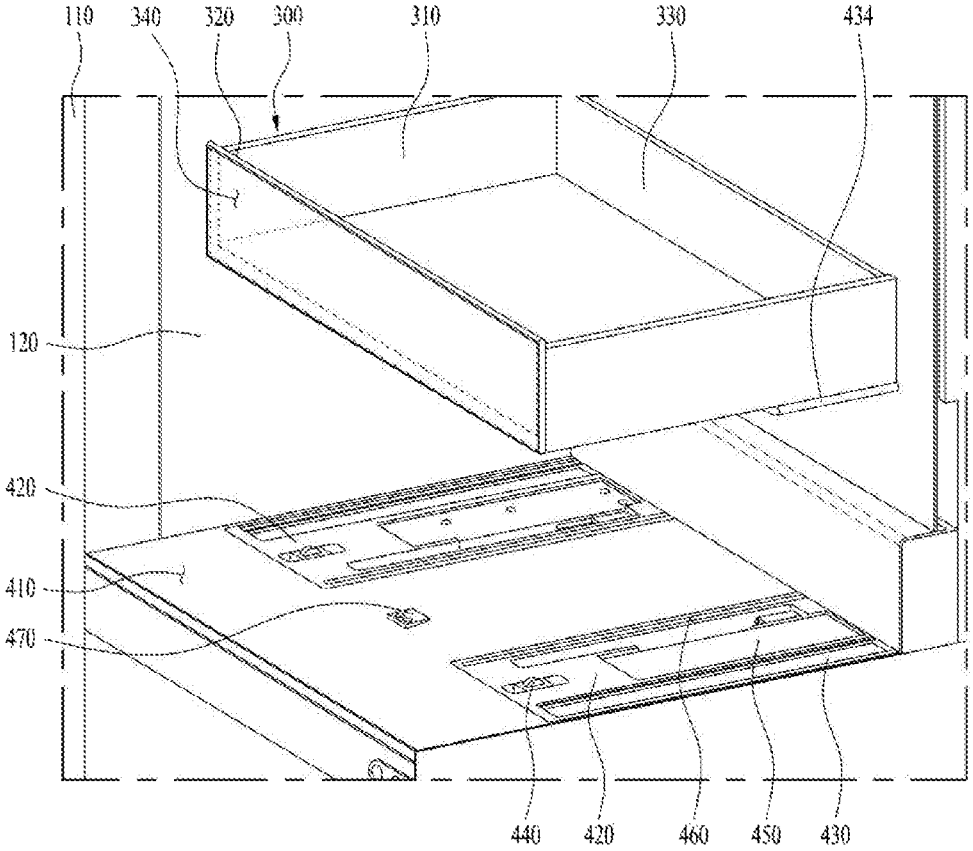
FIG. 6 is an exploded perspective view of a storage drawer and an actuator according to an embodiment of the present disclosure.
Figure 7:
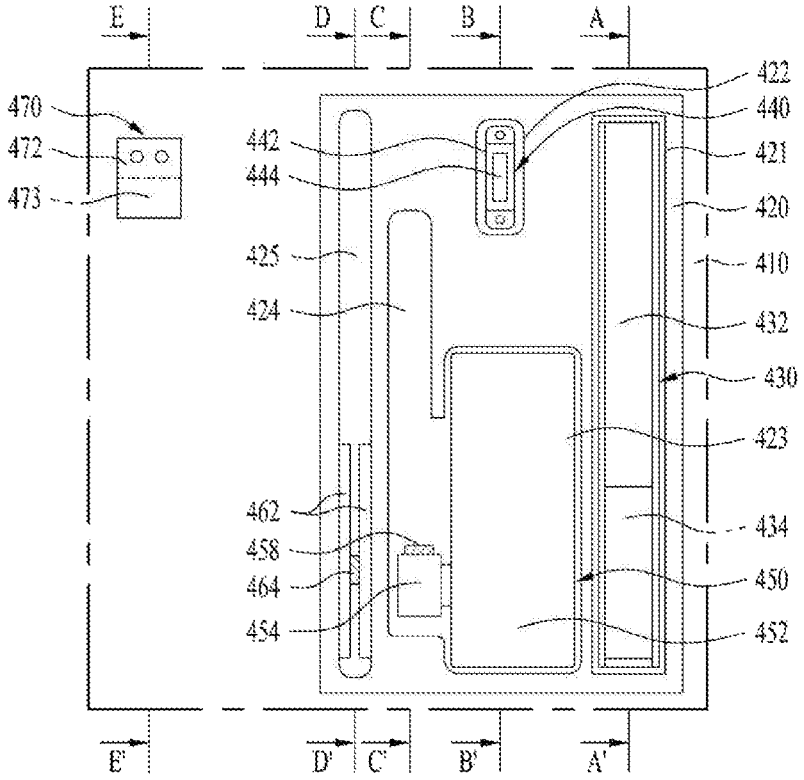
FIG. 7 is a plan view of an actuator of a storage drawer according to an embodiment of the present disclosure.

FIG. 6 is an exploded perspective view of a storage drawer and an actuator according to an embodiment of the present disclosure. Further, FIG. 7 is a plan view of an actuator of a storage drawer according to an embodiment of the present disclosure.

As shown, the drawer-receiving portion 400, which is a separate space separated from the first storage space 100*a* by the partitioning plate 134 of the first storage compartment 100, may to the storage drawer 300 configured to be retractable and extendable.

In one example, a mounted space 410 in which the actuator 420, which is involved in extending and retracting operations of the storage drawer 300, is installed is defined on the bottom face of the drawer-receiving portion 400. As shown, the actuator 420 includes actuators arranged symmetrically on both sides of the mounted space 410 with respect to a center of retracted and extended directions of the storage drawer. For convenience purposes, in a following description, only one side actuator 420 will be described as a representative.

In this embodiment, the actuator 420 has a plate shape (not limited) with a predetermined thickness and is inserted into the mounted space 410 of the drawer-receiving portion 400. Further, a surface of the actuator 420 may be disposed on an extension line of the mounted space 410.

In one example, a guide 430 for connecting the storage drawer 300 and a bottom face of the drawer-receiving portion 400 with each other and guiding the retracting and extending paths of the storage drawer 300, a roller assembly 440 for supporting the bottom face 316 of the storage drawer 300 to be maintained at a predetermined distance from the bottom face of the drawer-receiving portion 400, the guide 430 for moving the storage drawer 300 in the extended direction based on push of the storage drawer 300, a locker 460 for fixing the storage drawer 300 with a predetermined pressure when the storage drawer 300 is inserted into the drawer-receiving portion 400, and a stopper 470 for limiting an extension length of the storage drawer 300 may be installed on the actuator 420.

To this end, the actuator 420 may be provided with a plurality of grooves 421, 422, 423, and 425 formed therein for installing the guide 430, the roller assembly 440, the opening mechanism 450, and the locker 460 therein. The plurality of grooves formed in the actuator will be described in the description of the guide 430, the roller assembly 440, the opening mechanism 450, and the locker 460 in the actuator 420.

Figure 8:
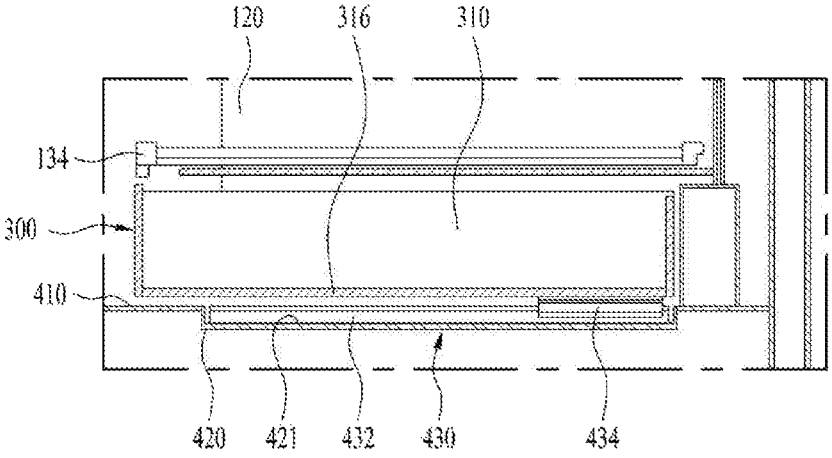
FIG. 8 is a cross-sectional view of a guide of a storage drawer according to an embodiment of the present disclosure.

Hereinafter, the guide 430 will be described in detail with reference to FIGS. 7 and 8.

As shown, the guide 430 is configured to guide the movement of the storage drawer 300 with respect to the drawer-receiving portion 400. The guide 430 includes a guide rail 432 installed on the actuator 420 and a movable portion 434 installed on the bottom face 316 of the body 310 of the storage drawer 300 and movably fastened to the guide rail 432.

In this embodiment, a guide mounted groove 421 for inserting the guide rail 432 therein may be defined or formed in the actuator 420. Further, the guide mounted groove 421 may be formed to have a length corresponding to a length of the guide rail 432 and to be in parallel with the retracted and extended directions of the storage drawer 300.

Further, the movable portion 434 constituting the guide 430 may be slidably fastened to the guide rail 432, so that the storage drawer 300 to which the movable portion 434 is fastened may move along the direction in which the guide rail 432 is formed.

Such guide 430 is preferably disposed at each outermost lower portion of the storage drawer 300, and a position and number of the guide 430 may vary based on a design of the storage drawer 300.

Further, the guide rail 432 of the guide 430 may be formed at a vertical level lower than the mounted space 410 of the drawer-receiving portion 400. Further, the movable portion 434 mounted on the bottom face 316 of the body 310 of the storage drawer 300 may be positioned below the mounted space 410 of the drawer-receiving portion 400 from the bottom face 316 of the body 310 of the storage drawer 300 and slidably fastened to the guide rail 432.

Thus, upon the extension and retraction of the storage drawer 300, as the movable portion 434 disposed on the bottom face of the storage drawer 300 slides along the guide rail 432 disposed on the actuator 420, the storage drawer 300 may be extended from and retracted into the drawer-receiving portion 400.

Figure 9:
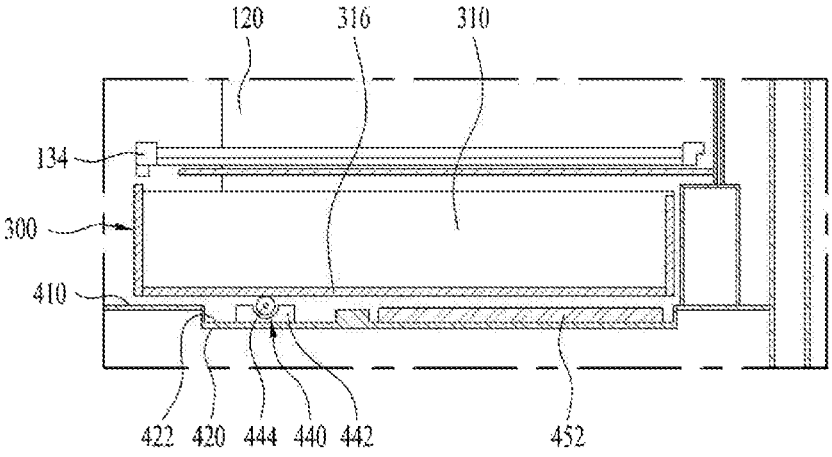
FIG. 9 is a cross-sectional view of a roller assembly of a storage drawer according to an embodiment of the present disclosure.

Hereinafter, the roller assembly 440 will be described in detail with reference to exemplary FIGS. 7 and 9.

As shown, the roller assembly 440, which is for supporting a front lower portion of the storage drawer 300 moved by the guide 430, may include a roller bracket 442 embedded in the actuator 420 and a roller 444 rotatably disposed on the roller bracket 442.

In this embodiment, a roller-bracket mounted groove 422 in which the roller bracket 442 of the roller assembly 440 is inserted and installed is defined in the actuator 420. The roller-bracket mounted groove 422 is disposed at a front end of the actuator 420 to support a front side of the bottom face 316 of the body 310 of the storage drawer 300 upon the retraction of the storage drawer 300.

Such roller bracket 442 of the roller assembly 440 is fixedly fastened to the roller-bracket mounted groove 422 by a separate fastener (not shown). The roller 444 rotatably disposed on the roller bracket 442 protrudes from a mounting space of the drawer-receiving portion 400 to support the bottom face 316 of the body 310 of the storage drawer 300.

Therefore, in the extension and retraction of the storage drawer 300, the roller 444 of the roller assembly 440 disposed on front side of the actuator supports the bottom face 316 of the body 310 of the storage drawer 300, so that the storage drawer may be extended into and retracted from the drawer-receiving portion 400.

Figure 10:
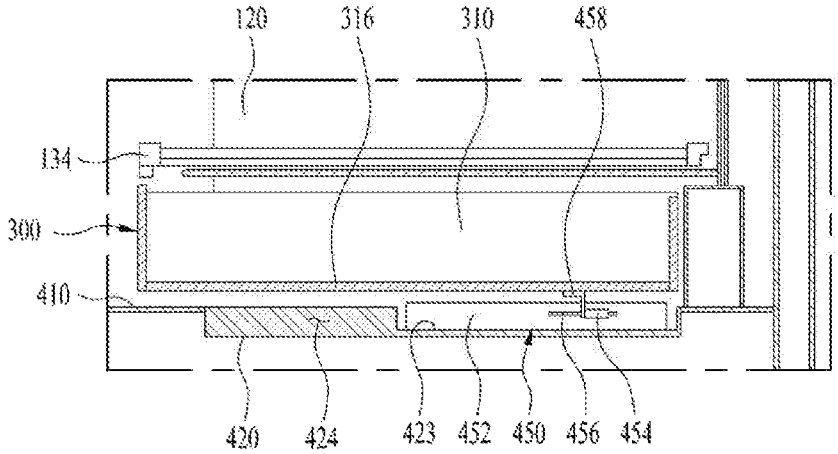
FIG. 10 is a cross-sectional view illustrating an opening mechanism of a storage drawer according to an embodiment of the present disclosure.

Hereinafter, the opening mechanism 450 will be described in detail with reference to exemplary FIGS. 7 and 10.

As shown, the opening mechanism 450 is configured to move the storage drawer 300 a predetermined distance in the extended direction when the user presses the storage drawer 300 in the retraction direction. The opening mechanism 450 includes a pressing bracket 458 fixed to the bottom face 316 of the body 310 of the storage drawer 300 and a push-opening damper 452 for, when a pressure is applied to the pressing bracket 458 to press the storage drawer 300 in the extended direction and the pressure is applied from the pressing bracket 458, removing the pressure applied to the storage drawer 300.

In this embodiment, the actuator 420 has a damper mounted groove 423 formed therein for the push-opening damper 452 to be inserted and installed therein. A slot 424 for moving the pressing bracket 458 of the storage drawer 300 based on the retraction and extension of the storage drawer is formed on one side of the damper mounted groove 423. In this embodiment, the damper mounted groove 423 and the slot 424 may be connected with each other in some regions. The push-opening damper 452 and the pressing bracket 458 may come into contact with each other in the region where the damper mounted groove 423 and the slot 424 are connected with each other.

In one example, a locked state of the push-opening damper 452 is activated and deactivated depending on action of external force by a user. An actuating protrusion 454 that generates a pressure to move the storage drawer 300 in the extended direction as the locked state is deactivated and a protrusion receiving groove 456 that movably inserts the actuating protrusion 454 therein and limits a movement distance of the actuating protrusion 454 are formed.

The actuating protrusion 454 extends to the slot 424 adjacent to the push-opening damper 452 installed in the damper mounted groove 423. Further, the actuating protrusion 454 is provided to press the pressing bracket 458 fastened to the bottom face 316 of the body 310 of the storage drawer 300 in the extended direction of the storage drawer 300.

Therefore, when the user presses the storage drawer 300 in the retracted direction to extend the storage drawer 300, the pressing bracket 458 of the storage drawer 300 presses against the actuating protrusion 454 of the push-opening damper 452 in an initial position thereof.

Accordingly, the actuating protrusion 454 of the push-opening damper 452 is pressed. Then, as the locked state of the actuating protrusion 454 in the initial position is deactivated, the actuating protrusion 454 moves the pressing bracket 458 in the extended direction of the storage drawer 300.

The movement distance of the actuating protrusion 454 may be limited by the protrusion receiving groove 456 and the storage drawer 300 may be extended by a length of the protrusion receiving groove 456. Therefore, the user may pull the storage drawer 300, which is extended by a predetermined distance, to fully extend the storage drawer 300 and store the food in the storage drawer 300.

In one example, when the user presses the open storage drawer 300 in the retracted direction to retract the storage drawer 300, the pressing bracket 458 of the storage drawer 300 presses against the actuating protrusion 454 of the push-opening damper 452 to the initial position and then the actuating protrusion 454, which has been moved to initial position thereof, is locked and fixed. Thus, the storage drawer 300 may be kept fully retracted.

Figure 11:
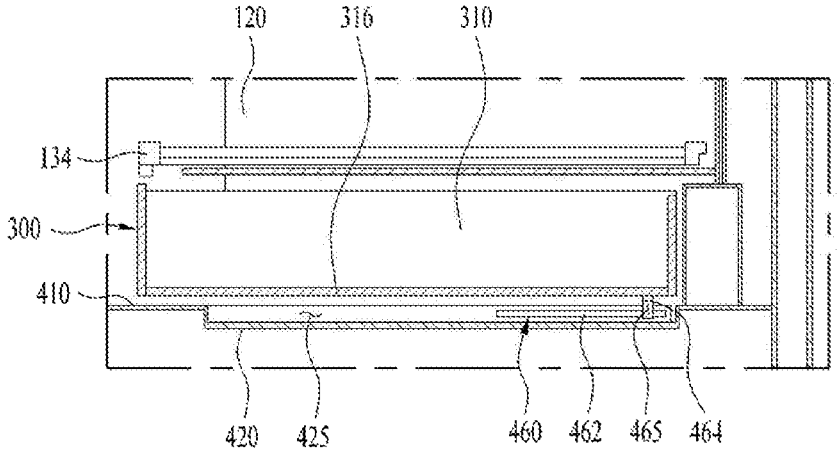
FIG. 11 is a cross-sectional view of a locker of a storage drawer according to an embodiment of the present disclosure.

Hereinafter, the locker 460 will be described in detail with reference to exemplary FIGS. 7 and 11.

As shown, the locker 460 is to prevent the storage drawer 300 from suddenly moving when the storage drawer 300 is extended and retracted based on the operation of the opening mechanism 450 described above, and simultaneously, to prevent the storage drawer 300 from moving while the storage drawer 300 is completely retracted.

The locker 460 includes a locker mounted groove 425 defined in the actuator 420 and having a length corresponding to the moving distance of the storage drawer 300, a frictional bracket 464 installed on the bottom face 316 of the body 310 of the storage drawer 300 and having a frictional face 465 formed in a direction parallel to a direction of formation of the locker mounted groove 425, and frictional members 462 located on both inner faces of the locker mounted groove 425 to impart a predetermined friction force to the frictional face 465 of the frictional bracket 464.

In this embodiment, the frictional member 462 may have a length that is less than or equal to half the length of the locker mounted groove 425 and may be positioned to form a frictional force on the frictional face 465 of the frictional bracket 464 when the storage drawer 300 is completely retracted.

The frictional force formed by the frictional member 462 is preferably less than an actuating force of the push-opening damper 452 of the opening mechanism 450. That is, when the friction force formed by the frictional member 462 is greater than the actuating force of the push-opening damper 452, the extension of the storage drawer 300 by the push-opening damper 452 is not achieved.

Therefore, in the extension of the storage drawer 300 based on the operation of the opening mechanism 450 or in the retraction of the storage drawer 300 by pressurization of the user, the frictional face 465 of the frictional bracket 464 provided on the bottom face 316 of the body 310 of the storage drawer 300 comes into contact with the frictional member 462 positioned in the locker mounted groove 425 to generate the frictional force. Then, the frictional force slows down the movement of the storage drawer 300.

In one example, the frictional member 462 is formed only in a portion of the locker mounted groove 425, so that the storage drawer 300 is decelerated by the frictional force only at the portion where the frictional member 462 is formed in the extension or retraction of the storage drawer 300. The friction force does not work at a portion where the frictional member 462 is not located, so that the storage drawer 300 is not decelerated.

Figure 12:
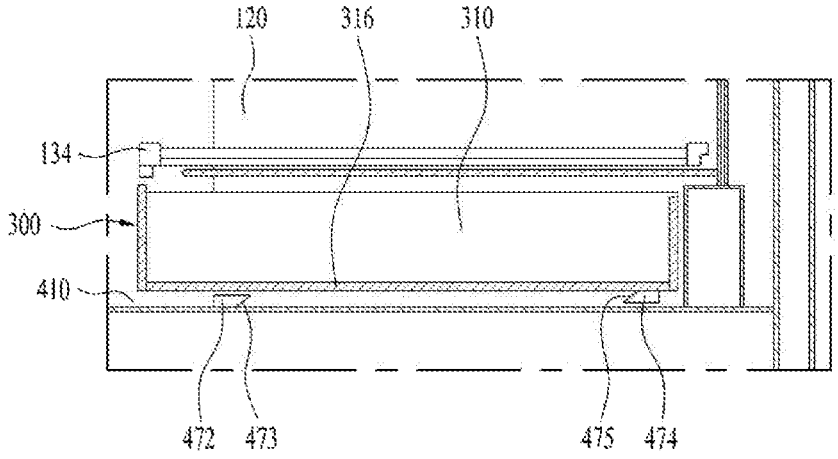
FIG. 12 is a cross-sectional view of a stopper of a storage drawer according to an embodiment of the present disclosure.

Hereinafter, the stopper 470 will be described in detail with reference to exemplary FIGS. 7 and 12.

As shown, the stopper 470 is for preventing the storage drawer 300 from being fully separated (removed) from the drawer-receiving portion 400 when the storage drawer 300 is extended therefrom. The stopper 470 may include a front stopping protrusion 472 provided at a front center portion of the mounted space 410 of the drawer-receiving portion 400 and a rear stopping protrusion 474 provided at a rear of the bottom face of the body 310 of the storage drawer 300.

In this embodiment, the front stopping protrusion 472 may be disposed such that the rear stopping protrusion 474 disposed on the bottom face 316 of the body 310 of the storage drawer 300 is mounted thereon to prevent the storage drawer 300 from further extending when the storage drawer 300 is extended by a certain distance.

In one example, a first inclined face 473 which is inclined rearward and upward from the mounted space 410 may be further formed on one face of the front stopping protrusion 472 (that is, a face facing the rear stopping protrusion 474). Further, a second inclined face 475 which is inclined forward and downward from the bottom face 316 of the body 310 of the storage drawer 300 may be further formed on the other face of the rear stopping protrusion 474 (that is, a face facing the front stopping protrusion 472).

Thus, the first inclined face 473 of the front stopping protrusion 472 and the second inclined face 475 of the rear stopping protrusion 474 may prevent deviating of the storage drawer 300 from the extended direction, and at the same, deviating of the rear stopping protrusion 474 from the front stopping protrusion 472 when the rear stopping protrusion 474 of the storage drawer 300 is in contact with the front stopping protrusion 472 of the mounted space 410.

According to the refrigerator 10 of the present disclosure as described above, the structure of the storage drawer 300 of the refrigerator 10 is improved, so that the user may easily open and use the storage drawer 300 using a simple operation.

Further, according to the refrigerator 10 of the present disclosure as described above, aesthetics of the storage drawer 300 may be improved by improving the structure of the storage drawer 300 of the refrigerator 10.

Although preferred embodiments have been depicted and described in detail herein, it will be apparent to those skilled in the relevant art that various modifications, additions, substitutions and the like can be made without departing from the spirit of the disclosure, and these are, therefore, considered to be within the scope of the disclosure, as defined in the following claims

What is claimed is:

1. A refrigerator comprising:

a first storage compartment comprising a first storage space defined therein;

a door disposed on the first storage compartment to provide access to the first storage space;

a drawer-receiving portion defined in the first storage space;

a storage drawer configured to extend in an extended direction from the drawer-receiving portion and to retract in a retracted direction into the drawer-receiving portion, the storage drawer comprising a pressing bracket disposed on a bottom face of the storage drawer and a frictional bracket disposed on the bottom face of the storage drawer and disposed to be movable inside the mounted groove based on extension and retraction of the storage drawer; and an actuator disposed on a bottom face of the drawer-receiving portion, wherein the actuator is configured to move the storage drawer in the extended direction as the storage drawer is pressed in the retracted direction, wherein the actuator comprises:

a push-opening damper disposed on the bottom face of the drawer-receiving portion for moving the storage drawer in the extended direction, the push-opening damper configured to be maintained to be in contact with the pressing bracket when the storage drawer is in a retracted state, and the push-opening damper configured to be pressed by the pressing bracket so as to deactivate a locked state thereof and then to press the pressing bracket such that the storage drawer moves in the extended direction as the storage drawer is pressed in the retracted direction, and a locker for fixing the storage drawer with a predetermined pressure when the storage drawer is inserted into the drawer-receiving portion, and wherein the locker comprises:

an elongate mounted groove extending in a parallel manner with the extended and retracted directions of the storage drawer, and a frictional member disposed inside the mounted groove to limit a speed of movement of the storage drawer by frictional resistance with the frictional bracket.

2. The refrigerator of claim 1, wherein the pressing bracket is configured to press against the push-opening damper such that the push-opening damper is returned to the locked state as the storage drawer moves in the retracted direction.

3. The refrigerator of claim 1, wherein the push-opening damper comprises:

an actuating protrusion configured:

to be in contact with the pressing bracket when the storage drawer is in the retracted state;

to press against the pressing bracket in the extended direction as the storage drawer is pressed in the retracted direction; and to be in contact with the pressing bracket as the storage drawer moves from an extended state in the retracted direction and then to be moved in the retracted direction of the drawer and locked; and a protrusion receiving groove receiving the actuating protrusion to limit a movement distance of the actuating protrusion.

4. The refrigerator of claim 1, wherein the actuator further comprises:

a guide to connect the storage drawer and a bottom face of the drawer-receiving portion with each other and to guide the retracting and extending paths of the storage drawer, wherein the guide comprises:

a guide rail disposed on a bottom face of the drawer-receiving portion, the guide rail extending along the extended and retracted directions of the storage drawer; and a movable portion disposed on a bottom face of the storage drawer, the movable portion configured to move along the guide rail.

5. The refrigerator of claim 1, wherein the refrigerator comprises a roller assembly supporting a bottom face of the storage drawer to guide movement of the storage drawer.

6. The refrigerator of claim 1, wherein a length of the frictional member is less than or equal to half a total length of the mounted groove.

7. The refrigerator of claim 1, wherein a front stopping protrusion is provided on a front portion of the bottom face of the drawer-receiving portion, and wherein a rear stopping protrusion is provided on a rear portion of the bottom face of the storage drawer to be mounted on the front stopping protrusion as the storage drawer extends in the extended direction.

8. The refrigerator of claim 5, wherein the roller assembly supports the bottom face of storage drawer.

9. The refrigerator of claim 1, wherein the door further comprises:

a manipulator configured to control the first storage compartment; and a display configured to display operation states of the first storage compartment.

10. The refrigerator of claim 1, further comprising:

a second storage compartment having a second storage space defined therein, wherein the second storage compartment is disposed below the first storage compartment, and wherein the second storage compartment operates independent of the first storage compartment.

11. The refrigerator of claim 10, wherein the second storage compartment comprises at least one drawer that extends from the second storage space to open the second storage space.

12. The refrigerator of claim 10, wherein the door further comprises:

a manipulator configured to control the first storage compartment and the second storage compartment; and a display configured to display operation states of the first storage compartment and the second storage compartment.

* * * * *